US008454151B2

(12) United States Patent
Kanome et al.

(10) Patent No.: US 8,454,151 B2
(45) Date of Patent: Jun. 4, 2013

(54) RECORDING APPARATUS

(75) Inventors: Yuji Kanome, Yokohama (JP); Takashi Horiba, Tokyo (JP); Hikaru Watanabe, Yokohama (JP); Eiichiro Tsuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 12/965,779

(22) Filed: Dec. 10, 2010

(65) Prior Publication Data

US 2012/0075366 A1 Mar. 29, 2012

(30) Foreign Application Priority Data

Sep. 27, 2010 (JP) ..... 2010-215087

(51) Int. Cl.
*B41J 2/01* (2006.01)

(52) U.S. Cl.
USPC ..... 347/102; 347/16; 347/104

(58) Field of Classification Search
USPC ..... 347/102, 104, 8, 16
See application file for complete search history.

(56) References Cited

U.S. PATENT DOCUMENTS

| | | | | |
|---|---|---|---|---|
| 6,390,618 | B1 * | 5/2002 | Wotton et al. | 347/102 |
| 7,527,371 | B2 * | 5/2009 | Yanagi et al. | 347/104 |
| 2007/0064077 | A1 * | 3/2007 | Konno | 347/102 |

FOREIGN PATENT DOCUMENTS

| | | | |
|---|---|---|---|
| JP | 2006-044021 | A | 2/2006 |
| JP | 2006-192599 | A | 7/2006 |
| JP | 2006-346932 | A | 12/2006 |
| JP | 2007-038518 | A | 2/2007 |
| JP | 2008-055839 | A | 3/2008 |
| JP | 2010-089499 | A | 4/2010 |

* cited by examiner

*Primary Examiner* — Lam S Nguyen
(74) *Attorney, Agent, or Firm* — Canon U.S.A., Inc. IP Division

(57) ABSTRACT

A recording apparatus, includes a recording head including ink nozzles configured to record an image on a sheet being conveyed along a direction, a reading unit configured to read the image recorded on the sheet by the recording head at a reading position, a supply unit configured to supply a gas to flow along the direction through a space where the ink nozzles are exposed, and a exhaust unit including an inlet which is placed in the vicinity of a position between the recording position and the reading position, at least a part of the gas flowed through the space being sucked from the inlet.

16 Claims, 8 Drawing Sheets

RECORDING APPARATUS

BACKGROUND OF THE INVENTION

1. Field of the Invention

The present invention relates to a recording apparatus including an inkjet type recording head.

2. Description of the Related Art

Japanese Patent Laid-Open No. 2006-44021 discloses a method for preventing nozzles from drying by supplying humidified gas (hereinafter referred to as humidified gas) to an area around ink nozzles in a printer in which a plurality of inkjet recording heads are arranged along a sheet conveying direction. Spaces between adjacent recording heads are filled with supporting members and the recording heads and the supporting members are arranged to form the same flat surface, so that a continuous narrow gap area is formed. By flowing humidified gas into the gap area, the recording heads are moisturized and prevented from drying.

Although not disclosed in Japanese Patent Laid-Open No. 2006-44021, a method is known in which an image reading unit reads and analyzes an image formed by a recording head to check the state of the recording head.

The applicant of the present invention found that when an image reading unit is added to an apparatus of Japanese Patent Laid-Open No. 2006-44021, a problem related to ink mist as described below occurs.

It is reasonable to place the image reading unit near a recording unit as much as possible on the downstream side of the recording unit because it is desirable that the image reading unit reads an image immediately after the image is formed by the recording head. The apparatus of Japanese Patent Laid-Open No. 2006-44021 has a configuration in which the humidified gas flows from upstream to downstream immediately below the recording head, and then naturally diffuses in the apparatus. While recording, a large amount of ink mist is generated accompanying the ink ejected from the recording head, and the ink mist flows from upstream to downstream along with the humidified gas. Therefore, if the image reading unit is placed in an area to which the gas flows, the ink mist easily attaches to an optical system of the image reading unit, so that dirt accumulates as the operation period of the apparatus increases. When a large amount of ink mist attaches to an illumination optical system, the intensity of the illumination decreases, and when a large amount of ink mist attaches to a light receiving optical system, the intensity of the receiving light decreases. In either case, a normal quantity of receiving light cannot be obtained, and the longer the accumulated operation time of the apparatus is, the more difficult to perform a correct check is. In other words, user maintenance such as a cleaning operation of the image reading unit that is soiled with the ink mist and a component replacement operation is required to be performed frequently.

The present invention firstly provides a recording apparatus in which an image reading unit is placed on the downstream side of a recording unit, image reading can be correctly performed for a long time, and the frequency of maintenance operations by a user can be reduced.

By the way, in the apparatus of Japanese Patent Laid-Open No. 2006-44021, a means for holding and conveying a sheet is a suction belt or a suction roller, which attracts and holds a reverse surface of a sheet by an electrostatic attraction method or a vacuum suction method. However, the sheet is held only at the reverse surface, and thus the sheet may not be properly attracted due to the type or characteristics of the sheet to be used. In particular, in the apparatus of Japanese Patent Laid-Open No. 2006-44021, the humidified gas of high humidity is introduced to the suction belt or the suction roller, so that electric charge is discharged from the attraction surface due to the humidity and the holding force of the sheet significantly decreases. Therefore, a sheet having high rigidity and strong curl cannot be held only by the attraction of the reverse surface of the sheet, and the sheet floats. The quality of the recorded image degrades in a portion where the sheet floats, and there is a risk that the sheet touches the recording head when the amount of float is large. When the vacuum suction method is employed to hold the sheet in the apparatus of Japanese Patent Laid-Open No. 2006-44021, the introduced humidified gas is sucked in by the vacuum, so that the humidification efficiency deteriorates significantly.

The present invention secondarily provides a recording apparatus which, when humidified gas is introduced between the recording head and the sheet to prevent the ink nozzles from drying, any type and any sort of sheet can be reliably held and the humidified gas can be efficiently used.

SUMMARY OF THE INVENTION

The present invention provides an apparatus comprising a recording head including ink nozzles configured to record an image on a sheet being conveyed along a direction, a reading unit configured to read the image recorded on the sheet by the recording head at a reading position, a supply unit configured to supply a gas to flow along the direction through a space where the ink nozzles are exposed, and an exhaust unit including an inlet which is placed in the vicinity of a position between the recording position and the reading position, at least a part of the gas flowed through the space being sucked from the inlet.

Further features of the present invention will become apparent from the following description of exemplary embodiments with reference to the attached drawings.

DESCRIPTION OF THE EMBODIMENTS

Hereinafter, an embodiment of a recording apparatus using an inkjet method will be described. The recording apparatus of this embodiment is a high-speed line printer that uses a long continuous sheet (continuous sheet longer than a unit of print (which is referred to as one page or a unit image) that repeats itself in a conveying direction). For example, the recording apparatus is suitable to be used in a field where a large amount of printing is performed, such as a print shop.

Figure 1:
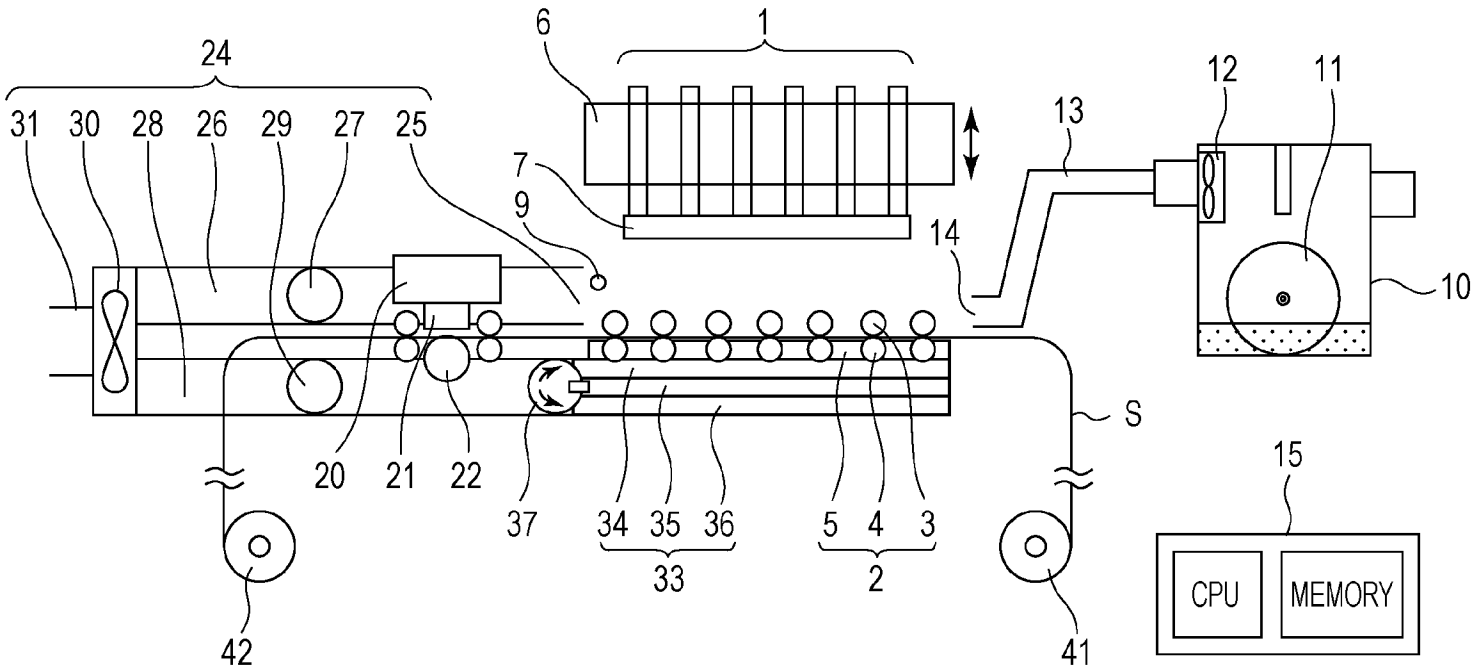
FIG. 1 is a transverse cross-sectional view showing a configuration of a recording apparatus.
Figure 2:
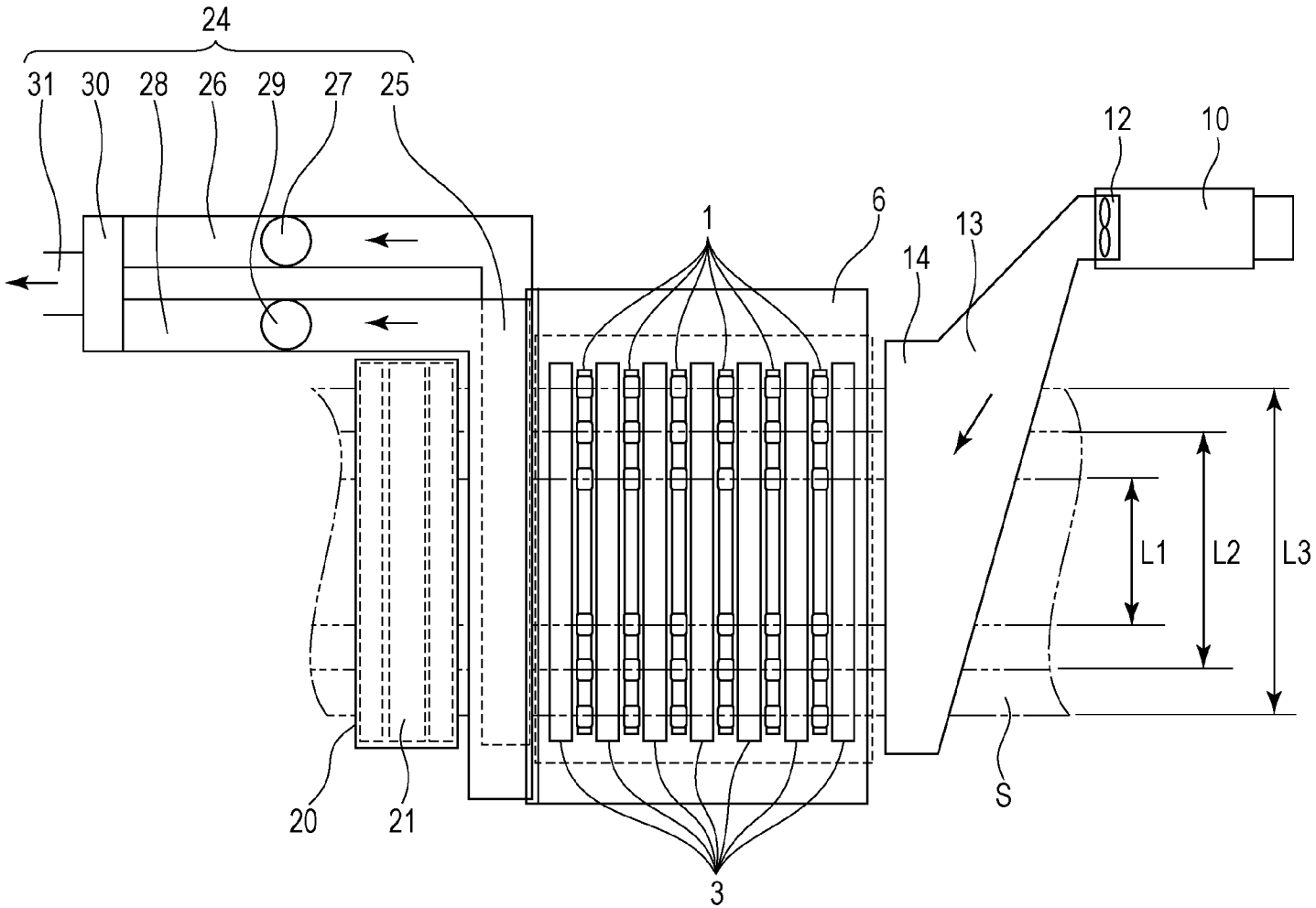
FIG. 2 is a top view when the recording apparatus in FIG. 1 is seen from the above.
Figure 3:
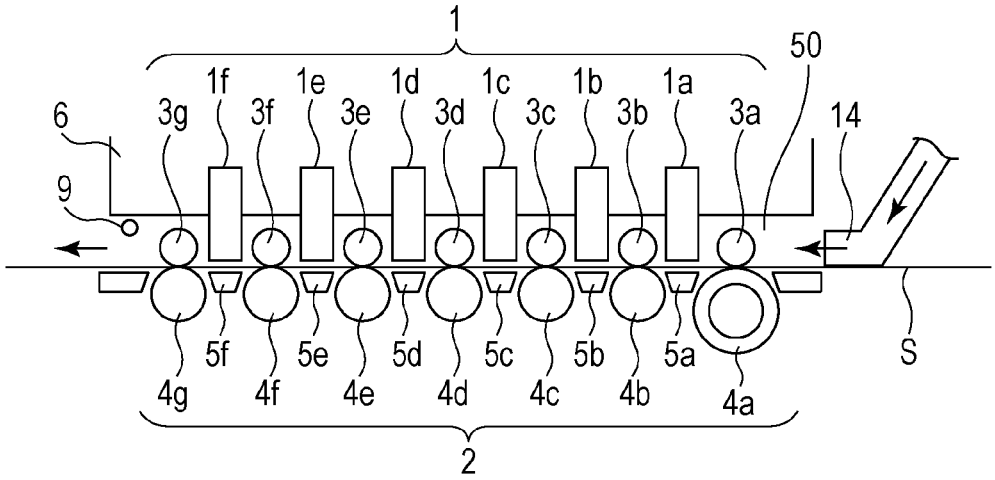
FIG. 3 is an enlarged view of a recording unit and a sheet conveying unit.

FIG. 1 is a transverse cross-sectional view of the recording apparatus of the embodiment in a standby state, and FIG. 2 is a top view of an apparatus configuration of the recording apparatus in FIG. 1 as seen from the above. FIG. 3 is an enlarged view showing a configuration of a recording unit and a sheet conveying unit during a recording operation.

As shown in FIG. 1, inside the recording apparatus, a sheet feed unit 41, the recording unit, a sheet conveying unit 2, a sheet winding unit 42, a humidification unit 10, an inspection unit 20, a gas exhaust unit 24, a control unit 15 are disposed. The sheet is conveyed downstream along a sheet conveyance path while printing. At an arbitrary position in the sheet conveyance path where the sheet is conveyed from the sheet feed unit 41 to the winding unit 42, a side toward the sheet feed unit 41 is referred to as "the upstream side", and the opposite side toward the winding unit 42 is referred to as "the downstream side".

The sheet feed unit 41 holds a continuous sheet wounded in a roll form and feeds the continuous sheet. A usable sheet is not limited to a sheet wounded in a roll form. For example, it is possible to use a sheet in which a perforation line is provided for each unit length and which is folded at each perforation line and stacked to be contained in the sheet feed unit 41. The sheet is not limited to a continuous sheet, but may be a cut sheet. The sheet winding unit 42 winds the continuous sheet on which image has been recorded in a roll form.

The recording unit includes a plurality of recording heads 1 arranged along a direction in which the sheet is conveyed. The recording heads 1 include line-type recording heads in which an ink nozzle array of an inkjet method is formed in a line form in a range that covers a maximum recording width of the sheet expected to be used. In this embodiment, six recording heads 1*a* to 1*f* (refer to FIG. 3) for six colors C (cyan), M (magenta), Y (yellow), LC (light cyan), LM (light magenta), and K (black) are sequentially arranged. The number of colors and the number of recording heads are not limited to six. As the inkjet method, it is possible to employ a method using heater elements, a method using piezoelectric elements, a method using electrostatic elements, a method using MEMS elements, and so on. Inks of each color are respectively supplied from ink tanks to the recording heads via ink tubes. The recording heads 1 are not limited to the recording heads of this embodiment. Each recording head may be formed by integrating the recording head and the ink tank together.

The plurality of recording heads are integrally held by a head holder 6. The head holder 6 is a plate-shape member including six openings into which the six recording heads are inserted. When the recording heads 1 are mounted in the openings, the recording heads 1 are gas-tightly held without a gap. Therefore, gas does not leak upward, and humidified gas described later and ink mist generated from the nozzles during recording are prevented from diffusing to a portion higher than the head holder 6. The head holder includes a mechanism (adjustment mechanism) that can move the recording heads 1 in a vertical direction (arrow direction in FIG. 1) so as to change the gap between the ink nozzles included in the recording heads 1 and the positions where the sheet passes at each recording position. When the sheet is in the recording position, the gap between the ink nozzles and the sheet can be changed, and when the sheet is not in the recording position, the gap between the ink nozzles and the height position where the sheet passes can be changed.

The sheet conveying unit 2 includes seven roller pairs which sandwiches a sheet S from both sides at locations near the recording positions. Each roller pair includes a pair of a pinch roller 3 (first roller) which is the upper roller and the driven roller, and a driving roller 4 (second roller) which is the lower roller and given a driving force. As shown in FIG. 3, the pinch rollers 3 includes pinch rollers 3*a* to 3*f* in an order from the upstream to the downstream, and the driving rollers 4 includes driving rollers 4*a* to 4*g* in an order from the upstream to the downstream. These driving rollers rotate by a driving force from the driving source. All the pinch rollers 3*a* to 3*g* have the same roller diameter. The driving rollers 4*b* to 4*g* have the same roller diameter, and only the driving roller 4*a* disposed in a most upstream position has a roller diameter larger than that of the other driving rollers. The sheet conveying unit further includes a platen 5 for supporting the sheet S from the below in the recording position. As shown in FIG. 3, the platen 5 is divided into six platens 5*a* to 5*f*, each divided platen is located between the plurality of driving rollers 4*a* to 4*g*, and the six divided platens face the six recording heads 1*a* to 1*f* respectively. From another view point, the plurality of driving rollers 4 are rotatably buried in openings of the platen 5. The gaps between the driving rollers 4 and the platen 5 are small, so that gas leakages from the gaps are small. The gas leaked downward from the gaps stays in a space closed by the tray unit 33 as described later, and does not diffuse into the inside of the recording apparatus.

At each position (recording position) facing the recording heads 1*a* to 1*f*, the upstream side and the downstream side of the sheet S are sandwiched by the roller pairs, and the sheet S is supported by the platen, so that the sheet S is stably conveyed. In particular, when the sheet is first guided into the sheet conveying unit 2, the leading edge of the sheet passes through a plurality of sandwiched positions at short intervals, so that floating of the leading edge of the sheet is suppressed and the sheet is stably guided into the sheet conveying unit 2.

A nozzle cap 7 is a cap for capping and sealing the ink nozzles to prevent the nozzles from drying when the recording apparatus is in a standby state in which the recording operation is not performed. By the control of the control unit 15, the nozzle cap 7 is inserted under the recording unit while the gap is widened by the adjustment mechanism, and the ink nozzles are capped at the same time. A humidity sensor 9 detects the humidity of the gas at a location near the recording head 1*f* which is disposed at the most downstream position.

The humidification unit 10 is a unit for generating a humidified gas (air which is humidified and whose degree of humidity is increased to a degree higher than that of a surrounding environment), and a part of a gas supply unit for supplying a humidified gas between the plurality of recording heads 1 and the sheet. The ink nozzles of the recording heads 1 are prevented from drying by the humidified gas. In this embodiment, a vaporizing-type humidification method is employed in which a rotating body 11 having a high water-absorbing property rotates while absorbing water accumulated in the bottom of the housing, and air taken in from the outside hits and passes though the rotating body 11, and thereby the air is humidified. It is not limited to this, but the humidification method of the humidification unit may be a vaporizing type, a water spray type, a steam type, and the like. The vaporizing type includes a moisture-permeable film type, a drop pervaporation type, a capillary type, and the like in addition to the rotating type which is used in this embodiment. The water spray type includes an ultrasonic type, a centrifugal type, a high-pressure spray type, a two-fluid spray type, and the like. The steam type includes a steam pipe type, an electric heating type, an electrode type, and the like.

The humidified gas generated by the humidification unit 10 is sent out by a fan 12 and ejected from an ejection outlet 14 through a duct 13, so that the humidified gas is supplied to a narrow space 50, to which the ink nozzles of the plurality of recording heads 1 are exposed, between the recording unit and the sheet conveying unit. A part of the humidified gas ejected from the ejection outlet 14 flows between the recording head 1*a* located at the most upstream position and the sheet S in the narrow space 50. Next, the humidified gas flows in a space between the pinch roller 3*b* and the head holder 6, a space between the adjacent recording head 1*b* and the sheet S, and so forth while meandering up and down (refer to FIG. 3). The narrow space 50 is a space to which the ink nozzles of each of the plurality of recording heads 1 are exposed, so that it is possible to prevent ink ejection failure due to drying by moisturizing the ink nozzles with the supplied humidified gas.

The control unit 15 is a unit that controls each unit in the entire recording apparatus. The control unit 15 includes a controller having a CPU, a memory, and various control sections, an external interface, and a manipulating portion where a user performs input/output operations.

Figure 5:
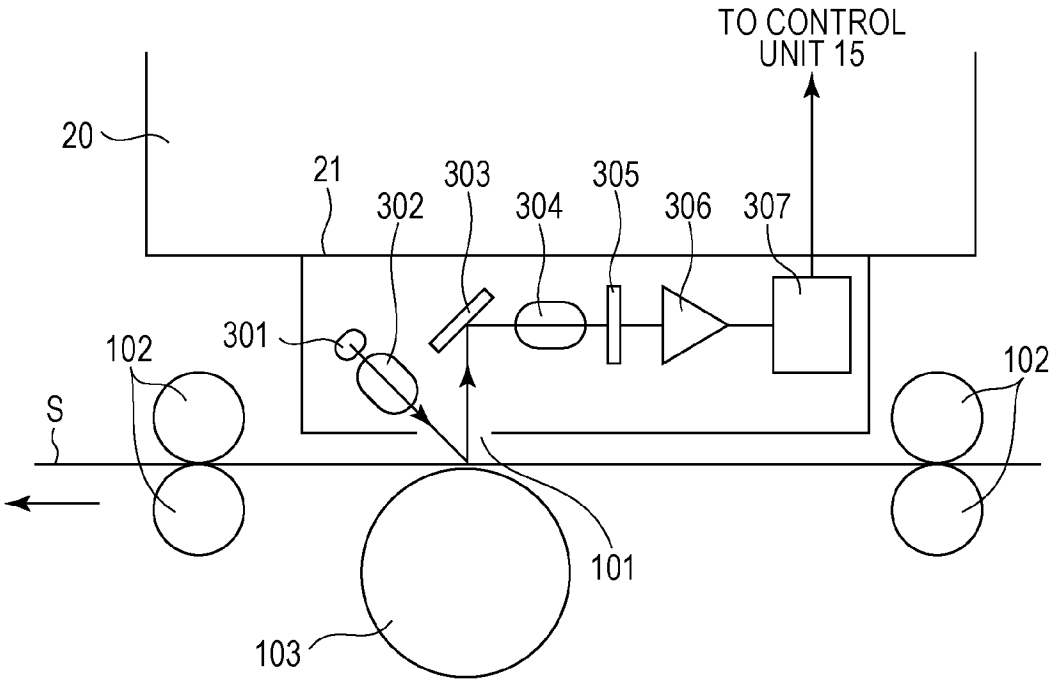
FIG. 5 is a transverse cross-sectional view showing a configuration of a reading unit.

The inspection unit 20 includes a reading unit 21 that reads an image recorded on the sheet by the recording heads 1 at a reading position on the downstream side of the recording position. FIG. 5 is a cross-sectional view showing a detailed configuration of the inspection unit 20. A conveying roller pair 102 is provided at two points located respectively on the upstream side and the downstream side of the reading unit 21 in the conveying direction (first direction) of the sheet S from upstream to downstream. The sheet S conveyed by the conveying roller pairs 102 moves under the reading unit 21 while the back surface of the sheet S is supported by a roller 103.

The reading unit 21 contains an illumination optical system and a reading optical system. The illumination optical system includes a light source 301 and a light guide body 302. The light source 301 is a white LED and emits a continuous spectrum having visible light wavelengths (400-700 nm). The light emitted from the light source 301 is guided by the light guide body 302 and emitted from a slit 101 which is a through hole having an elongated rectangle shape provided in the bottom surface of the housing of the reading unit 21 to the outside of the housing. The light passing through the slit 101 illuminates the surface of the sheet S in a line shape along the width direction of the sheet (second direction: direction perpendicular to the surface of the sheet). The illuminated area is the reading position. The reading optical system includes a reflection mirror 303, a reduction imaging lens 304, and a line sensor 305. A part of the light reflected on the illuminated surface of the sheet S is also passes through the slit 101 and goes to the reflection mirror 303. The light reflected and folded by the reflection mirror 303 is formed into a reduced image on the line sensor 305 by the reduction imaging lens 304.

The line sensor 305 is a CCD image sensor or a CMOS image sensor in which a large number of photo detectors are formed in a line shape along the width direction of the sheet. In the line sensor 305, the photo detectors are arranged at a predetermined pitch (for example, at 600 dpi on the sheet) over a length which is calculated by reducing the range covering the maximum width of the sheet S (maximum reading width of a scanner) by a reduction rate of the reduction imaging lens 304. In the line sensor 305, three photo detector arrays corresponding to three colors RGB are arranged in parallel and covered by one of R, G, and B color filters respectively. The line sensor 305 outputs three analog signals generated by reading R, G, and B components for each unit of reading (one pixel) on the surface of the sheet S. The output signals from the line sensor 305 are amplified by an amp 306, and then converted into digital signals by an A/D convertor 307. While the sheet S moves in the direction indicated by an arrow in FIG. 5, the reading unit 21 reads the surface of the sheet S, so that a two-dimensional image formed on the sheet S can be read. The signals outputted from the A/D convertor 307 are inputted into the control unit 15, and in the control unit 15, an image analysis for inspection of the print is performed. The inspection of the print includes a state inspection of recording elements of the print head (inspection of ink ejection state and nozzle state such as recording gradation or the like), an inspection of position shift of the formed image as a whole, and the like.

In this embodiment, light is divided into R, G, and B colors by using color filers in the line sensor 305. However, it is not limited to this. For example, it is possible to employ a form in which the light source 301 is formed by three color LEDs of R, G, and B, light is emitted while sequentially switching the color of the light, and the line sensor 305 has one photo detector array. Instead of the reduction imaging lens 304, the same size imaging optical system including a lens array in which a plurality of gradient index lenses (GRIN lenses) are bundled in an array form may be used.

Return to FIGS. 1 and 2. The gas exhaust unit 24 includes a first duct 26 and a second duct 28, and at the end of these ducts, a common exhaust fan 30 and exhaust port 31 are provided. As shown in FIG. 2, both of the first duct 26 and the second duct 28 are arranged to avoid the inspection unit 20. The exhaust fan 30 can be controlled by the control unit 15 so that the rotation speed (rotation per minute: rpm) can be changed. As the rotation speed is increased, the exhaust output of the gas exhaust unit is increased, and as the rotation speed is decreased, the exhaust output of the gas exhaust unit is decreased.

The starting end of the first duct 26 is an inlet 25, and the inlet 25 is placed in a position on the upstream side of the reading position and on the downstream side of the recording position. The inlet 25 is located in a position near the recording head 1*f* which is located at the most downstream position among the plurality of recording heads 1, and in a position nearer to the recording heads 1 than the sheet S. When the exhaust fan 30 provided at the end of the first duct 26 rotates, the gas sucked from the inlet 25 is exhausted from the exhaust port 31 to the outside of the recording apparatus main body.

In a flow passage in the first duct 26, a trap portion 27 that captures ink mist flying in the gas is provided between the inlet 25 and the exhaust fan 30. The trap portion 27 is, for example, a fine filter that captures ink mist. Or, the trap portion 27 may be a plurality of ribs formed on the inner wall of the duct along the direction of gas flow. When the trap portion 27 is the ribs, the gas flowing in the flow passage in the duct forms a small vortex in a small space between the ribs adjacent to each other, and the ink mist attaches to the wall surfaces of the ribs, so that the ink mist is captured. In the same manner, a trap portion 29 is provided in a flow passage in the second duct 28. The exhaust fan 30 is placed at the ends of the ducts on the downstream side of the trap portions, so that the gas in which the ink mist is reduced in the trap portions comes into contact with the exhaust fan 30, and thus the exhaust fan 30 is prevented from being soiled with the ink mist. If the exhaust fan 30 is placed on the upstream side of the trap portions, the exhaust fan 30 is significantly soiled.

Below the sheet conveying unit 2, the tray unit 33 which covers a predetermined range is provided. The tray unit 33 provides a closed small space below the sheet conveying unit 2 so that the gas leaked downward to below the sheet conveying unit 2 from the narrow space in which the humidified gas is provided does not diffuse into the inside of the apparatus. The tray unit 33 includes a plurality of stacked layers of trays having different sizes according to the size of the sheet to be used. In this embodiment, it is assumed that basically, three sheet sizes (sheet widths L1, L2, and L3 shown in FIG. 2) are used.

Figure 4A:
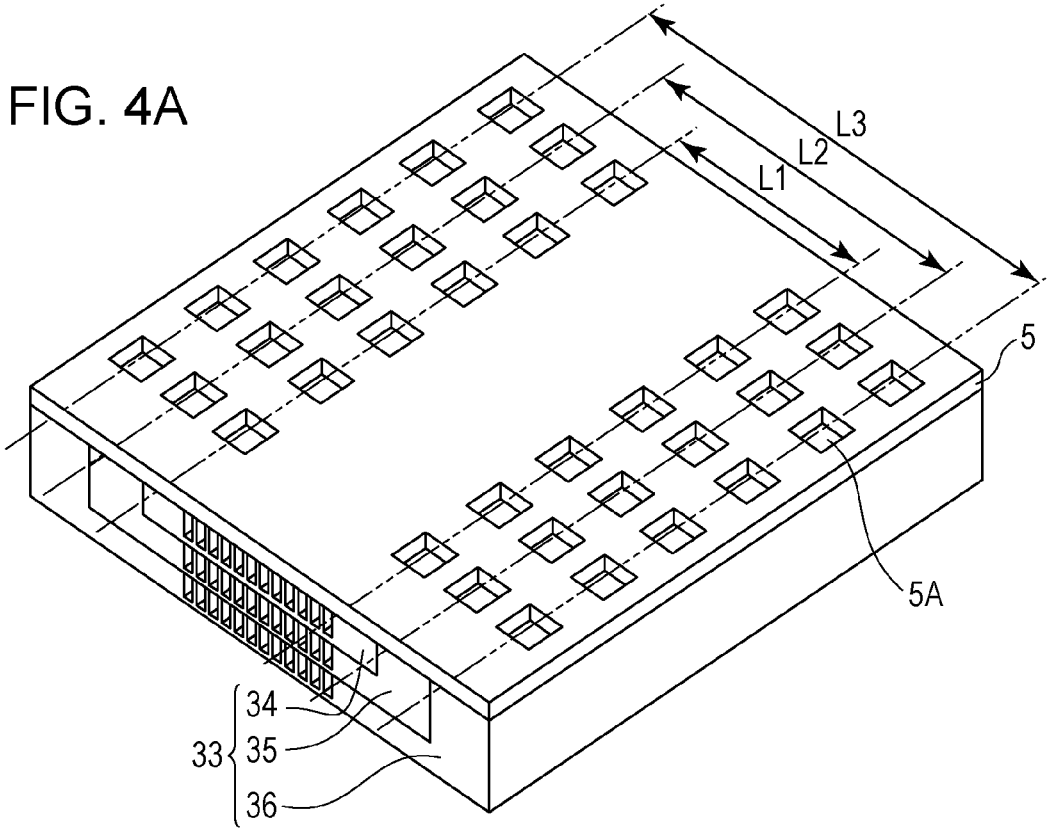
FIG. 4 is an enlarged view showing a configuration of a tray unit.
Figure 4B:
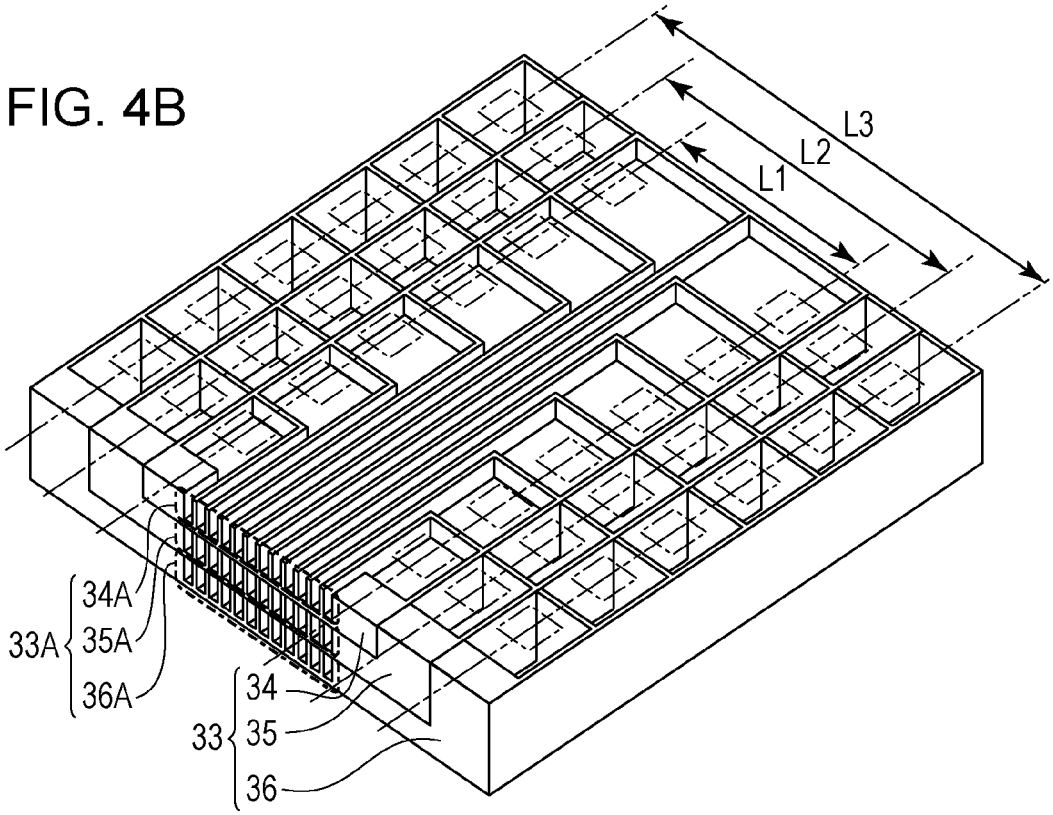

FIG. 4 is an enlarged view showing a detailed configuration of the tray unit 33. FIG. 4A is a view showing a combined state of the platen 5 and the tray unit 33, and FIG. 4B is a view depicting only the tray unit 33 by removing the platen 5. In the platen 5, a plurality of holes 5A, which receives ink ejected to the outside of the sheet when a borderless print is performed at the positions corresponding to both side edges of the sheets having the sheet sizes of L1, L2, and L3, are regularly formed along the first direction. Through the holes 5A, the unnecessary ink is discharged downward and the humidified gas moves downward. In FIG. 4A, the view of the platen 5 is simplified to help understand the positional relationship between the holes 5A. Actually, the upper surface of the platen 5 is not a flat surface, and a plurality of linear concave portions, which extend between the plurality of driving rollers 4, are provided integrally with the platen 5 or separately from the platen 5. Below the platen 5, three trays including a first tray 34, a second tray 35, and a third tray 36 are stacked in accordance with each sheet size. The first tray 34 has a width a little larger than the sheet width L1, the second tray 35 has a width a little larger than the sheet width L2, and the third tray 36 has a width a little larger than the sheet width L3. Each tray includes small divided spaces respectively facing the plurality of holes 5A inside the trays. A narrow passage is connected to each small space, and all passages are connected to one outlet 33A. More specifically, a plurality of passages of the first tray 34 are connected to an outlet 34A, a plurality of passages of the second tray 35 are connected to an outlet 35A, and a plurality of passages of the third tray 36 are connected to an outlet 36A. The outlet 34A, the outlet 35A, and the outlet 36A are concentrated in one place to form the outlet 33A.

Return to FIGS. 1 and 2. A path switching unit 37 selectively connects one of these outlets to the second duct 28. In the flow passage in the second duct 28, a gas flow is generated by the exhaust fan 30, and the gas in the internal space in the selected tray is exhausted from the exhaust port 31 to the outside of the recording apparatus main body. At this time, the ink mist is captured by the trap portion 29, and the exhausted gas includes a reduced amount of ink mist.

The gas exhaust unit 24 sucks at least a part of the humidified gas from the inlet 25 of the first duct 26 at a position on the upstream side of the inspection unit 20 and on the downstream side of the recording heads 1, and exhausts the humidified gas to a place (outside of the apparatus) different from the inlet 25. The gas exhaust unit 24 also exhausts the humidified gas leaked downward to below the sheet conveying unit 2 to the outside from the try unit 33 through the second duct. Therefore, the ink mist generated during a recording operation is prevented from attaching to the optical system of the reading unit in the inspection unit 20 and from degrading reading performance. Consequently, image reading can be correctly performed for a long time, and the frequency of maintenance operations by a user can be reduced.

Figure 6:
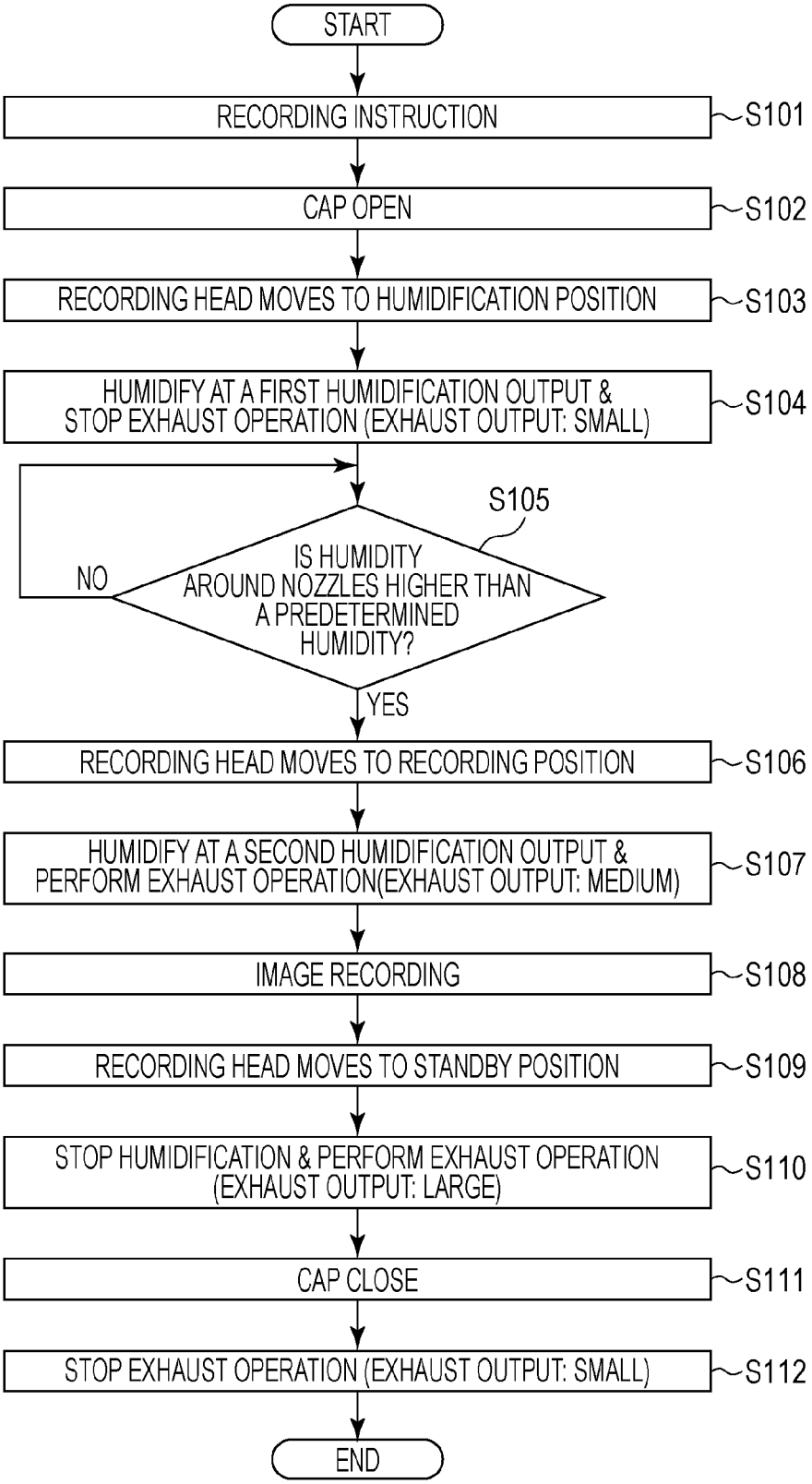
FIG. 6 is a flowchart showing an operation sequence of the recording apparatus.
Figure 7:
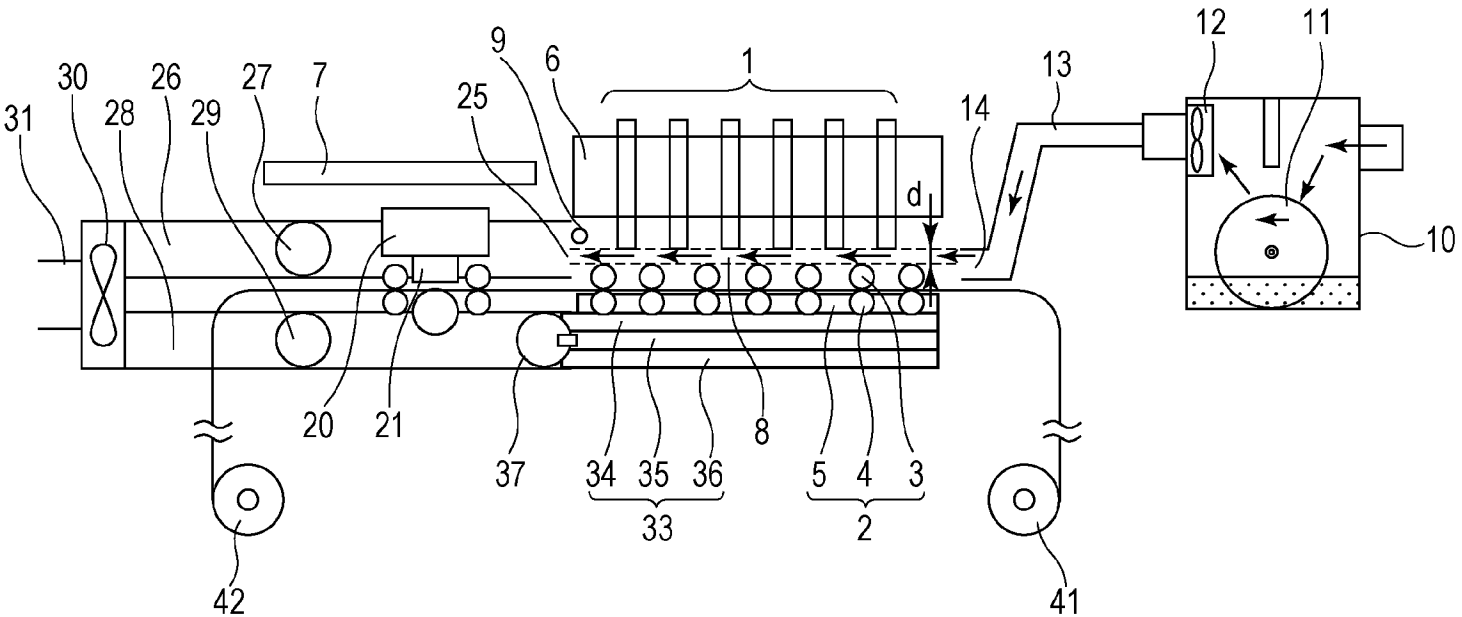
FIG. 7 is a configuration diagram of the recording apparatus in a humidified state before a recording operation.
Figure 8:
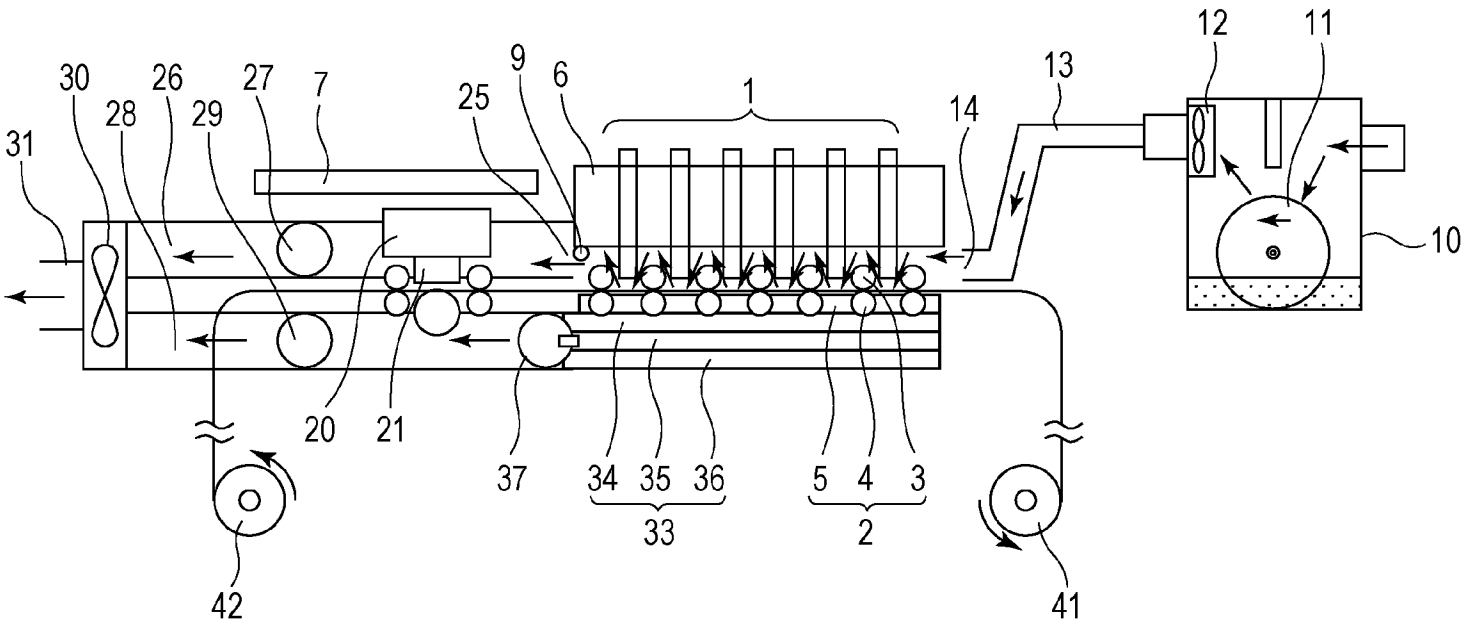
FIG. 8 is a configuration diagram of the recording apparatus in a humidified state during a recording operation.

Next, a sequence of the recording operation will be described. FIG. 6 is a flowchart showing the sequence of the operation of the recording apparatus. The sequence described below is performed by a control of the control unit 15. FIG. 7 is a configuration diagram showing a humidified state before the recording operation of the recording apparatus (second humidified state). FIG. 8 is a configuration diagram showing a humidified state during the recording operation of the recording apparatus (first humidified state).

In the standby state, as shown in FIG. 1, the ink nozzles are capped by the nozzle cap 7 in the recording apparatus. The height position of the head holder 6 at this time is referred to as a standby position. In step S101, the recording apparatus receives an instruction for starting recording. In step S102, the capping state by the nozzle cap 7 is released, and the nozzle cap 7 is evacuated (cap open). FIG. 7 shows a state in which the nozzle cap 7 is evacuated to the left of the diagram.

In step S103, the head holder 6 is moved from the standby position (third gap, refer to FIG. 1) to a humidification position having a predetermined gap (first gap, refer to FIG. 7) smaller than the third gap by the adjustment mechanism.

In step S104, the humidification unit 10 starts generation of the humidified gas and the humidified gas is supplied from the ejection outlet 14 of the gas supply unit. The gas supply unit sends the humidified gas by a large amount of gas flow at a maximum humidification output (first humidification output). The humidification output is adjusted by the rotation speed of the rotating body 11 and the rotation speed of the fan 12. At this time, the gas exhaust unit 24 stops exhaust operation (exhaust output: small), and does not perform active exhaust of the humidified gas.

The first gap at the humidification position can be larger than the diameter of the pinch rollers 3 (all the rollers have the same diameter). By satisfying the above condition, as shown in FIG. 7, a straight gas passage 8 without obstacles is formed along the sheet conveying direction between the uppermost portions of the plurality of pinch rollers 3 and a surface in which the ink nozzles of the recording heads 1 are formed. In the straight gas passage 8 having a width d (a virtual passage formed between two dashed lines in FIG. 7), the humidified gas supplied from the upstream smoothly flows to the downstream. Therefore, when a large amount of humidified gas is sent by the gas supply unit at the maximum output thereof, it is possible to cause the entire narrow space to be a desired humidification state in a short period of time. In this case, the gas exhaust unit stops the exhaust operation (exhaust output: small), so that the humidified gas sent to the space is not actively discharged, and the desired humidification state can be obtained in a shorter period of time. At this time, ink is not ejected from the recording heads 1, so that the ink mist is not generated.

According to an experiment, in particular, it is preferable that the width d of the gas passage 8 is 2 mm or more. When the width d is smaller than 2 mm, the flow resistance in the gas passage becomes large, and the period of time required for the humidity around the nozzles to reach a predetermined humidity increases significantly. For example, at the start of the apparatus, the required time from when the humidified gas supply is started to when a humidity sensor 9 placed in the most downstream position detects the predetermined humidity is 10 seconds when d=20 mm, 30 seconds when d=2 mm, 100 seconds when d=0 mm, and 400 seconds when d=−30 mm. As the value of the width d decreases, the required time increases sharply. In particular, when d is a minus value (when the bottom surface of the head is lower than the top portions of the pinch rollers 3), a significantly large amount of time is required. However, when the width d is too large, the movement time required to move the head holder 6 by the adjustment mechanism increases. Considering the balance thereof, it is preferable that the upper limit is 50 mm. In this embodiment, it is defined that d=20 mm. In this way, the gap (first gap) between the ink nozzles and the sheet in the recording position at the humidification position is set to be at least larger than the diameter of the pinch rollers 3. More preferably, the first gap is set to be larger than the diameter of the pinch rollers 3 by 2 mm to 50 mm.

In step S105, whether or not the humidity around the nozzles becomes a predetermined humidity or more is determined on the basis of the detection of the humidity sensor 9, and it is waited until the humidity becomes a predetermined humidity or more. When the humidity becomes a predetermined humidity or more, the process proceeds to step S106.

In step S106, the head holder 6 is moved from the humidification position shown in FIG. 7 to the recording position having a further smaller predetermined gap (second gap) shown in FIGS. 8 and 3 by the adjustment mechanism. In the recording position, the nozzle arrays of the recording heads 1 approach the sheet S, and the gap becomes suitable for the recording heads 1 to eject ink and perform recording. In this embodiment, it is defined that the second gap is 1 mm. At this time, as shown in FIG. 3, in the sheet conveying direction, the recording heads 1*a* to 1*f* enter the gaps between the pinch rollers 3*a* to 3*f*, and the pinch rollers and the recording heads are alternately arranged in terms of positional relationship. In other words, along the sheet conveying direction, one pinch roller 3 is located between two recording heads adjacent to each other (a first recording head and a second recording head).

In step S107, the output of the gas supply unit is changed to a second humidification output that is smaller than the first humidification output. At the same time, the operation of the gas exhaust unit is started to discharge the humidified gas.=The exhaust operation of the gas exhaust unit 24 is started, and the humidified gas is discharged at a normal exhaust output (exhaust output: medium). In other words, the control unit 15 controls the gas exhaust unit 24 so that, when the gas is supplied while the gap is the second gap, the exhaust output of the gas exhaust unit 24 becomes larger than that when the gas is supplied while the gap is the first gap.

In step S108, the image recording is started. During the recording operation, the gas supply unit continuously supplies the humidified gas while maintaining the second humidification output. At the same time, the gas exhaust unit 24 continuously exhausts the humidified gas including the ink mist while maintaining the exhaust output at a constant level (exhaust output: medium). The control unit 15 sets the exhaust output of the gas exhaust unit 24 (the rotation speed of exhaust fan 30) so that the gas flow including the ink mist generated during recording is appropriately exhausted from the first duct 26 and the second duct 28.

As shown by an arrow in FIG. 8, the humidified gas ejected from the ejection outlet 14 flows meandering up and down in the narrow space 50 to which the ink nozzles are exposed. Since the humidity becomes a predetermined humidity or more in advance in steps S102 to S105, it is possible to maintain the humidity in the narrow space by supplying a necessary minimum humidified gas to maintain the humidity. If the humidified gas, which is supplied in steps S102 to S105, is not supplied in advance, it takes a long time for the humidity in the entire gas flow path from the most upstream position to the most downstream position to reach the predetermined humidity, so that the standby time at the start of the recording apparatus becomes long.

During the recording operation, it is possible to reduce the power consumption and suppress the consumption of the water accumulated in the humidification unit 10 by operating at the second humidification output smaller than the first humidification output. When the gas flow velocity is too fast around the ink nozzles during recording, the flight of the ink ejected from the nozzles is affected and ink placement accuracy degrades. In order to suppress the degradation of the ink placement accuracy, it is effective to decrease the humidification output of the gas supply unit and the exhaust output of the gas exhaust unit and decrease the flow velocity of the humidified gas in the narrow space.

The exhaust output of the gas exhaust unit 24 in the recording operation which is set in step S107 may be set in accordance with the size or type of the sheet to be used. For example, when the size of the sheet is changed, the generation amount of ink mist may change. The amount of ink mist generated during the recording operation may change depending on the material of the sheet or the thickness of the sheet. Therefore, when the generation amount of ink mist is expected to be large, it is possible to set the exhaust output of the gas exhaust unit to be higher in accordance with the sheet to be used.

When a scheduled image recording is completed in step S108, the process proceeds to step S109. In step S109, the head holder 6 is moved from the recording position to the initial standby position (third gap) shown in FIG. 1 by the adjustment mechanism.

In step S110, the supply of the humidified gas from the gas supply unit is stopped. The humidification unit 10 stops the rotation of the rotating body 11 and stops the rotation of the fan 12. At the same time, the exhaust operation of the gas exhaust unit 24 is switched to a maximum output (exhaust output: large). The reason why the output of the gas exhaust unit is increased is to exhaust the humidified gas including the ink mist which is remained in the space in a short period of time.

Thereafter, in step S111, the nozzle cap 7 is inserted in a capping position below the recording unit, and the ink nozzles are set in a capping state (cap close).

In step S112, after the capping is completed, it is waited for a period of time in which the humidified gas is estimated to be fully exhausted, and then the exhaust operation of the gas exhaust unit 24 is stopped (exhaust output: small). Then, the sequence is completed.

The recording apparatus according to this embodiment described above tightly holds the sheet using a plurality of roller pairs, so that even a sheet having high rigidity and strong curl can be prevented from floating, and it is possible to perform recording with high image quality on various types and sorts of sheets. Since an electrostatic attraction belt which is used in the apparatus of Japanese Patent Laid-Open No. 2006-44021 is not used, it does not occur that electric charge is discharged from the attraction surface due to the humidity of the introduced humidified gas and the holding force of the sheet significantly decreases.

The recording apparatus according to this embodiment can create an environment in which the recording head is appropriately moisturized in a short period of time, so that a recording apparatus whose start-up time is short is realized. In addition, the gas exhaust unit including the inlet from which at least a part of the humidified gas is sucked at a position on the upstream side of the reading position and on the downstream side of the recording position is provided on, so that the ink mist generated during a recording operation is prevented from attaching to the reading unit 21 in the inspection unit 20 and from degrading reading performance. Further, when the recording operation is completed, the exhaust output of the gas exhaust unit is increased temporarily and the humidified gas including ink mist remaining in the space is exhausted to the outside quickly, so that the ink mist after recording is prevented from diffusing into the inside of the apparatus.

Although the embodiment described above includes a gas supply unit for actively flowing the humidified gas under the recording head, it is possible to extend the range of application of the present invention to a recording apparatus which does not have such a gas supply unit to obtain the effect of the present invention. Even if the recording apparatus does not have a gas supply unit, when the sheet moves quickly from upstream to downstream, a slight gas flow occurs driven by the moving sheet under the recording heads from upstream to downstream, so that the ink mist moves easily to the downstream side where the reading unit is located. Therefore, if the inlet of the gas exhaust unit is placed on the upstream side of the reading position of the reading unit and on the downstream side of the recording position, it is possible to prevent the ink mist from attaching to the reading unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-215087 filed Sep. 27, 2010, which is hereby incorporated by reference herein in its entirety.

What is claimed is:

1. An apparatus comprising:

a recording unit having a first recording head and a second recording head each including ink nozzles configured to record an image on a sheet being conveyed along a direction;

a sheet conveying unit including at least a roller pair including a first roller and a second roller which sandwich the sheet at a position between a recording position of the first recording head and a recording position of the second recording head, a reading unit configured to read the image recorded on the sheet by the recording head at a reading position;

a supply unit configured to supply a gas to flow along the direction through a space where the ink nozzles are exposed; and an exhaust unit including an inlet which is placed in the vicinity of a position between the recording position of the second recording head and the reading position, at least a part of the gas flowed through the space being sucked from the inlet, wherein the first roller is located between the first recording head and the second recording head at least when recording, and at least a part of the gas supplied by the supply unit flows through a gap between the first recording head and the sheet and a gap between the second recording head and the sheet in the space.

2. The apparatus according to claim 1, further comprising:

a tray configured to cover the bottom of the sheet conveying unit;

wherein the exhaust unit also exhausts the gas from an internal space of the tray.

3. An apparatus comprising:

a recording unit having a first and a second recording heads each including ink nozzles configured to record an image on a sheet being conveyed along a direction;

a sheet conveying unit including at least a roller pair including a first roller and a second roller which sandwich the sheet at a position between a recording position of the first recording head and a recording position of the second recording head, a reading unit configured to read the image recorded on the sheet by the recording head at a reading position;

a supply unit configured to supply a gas to flow along the direction through a space where the ink nozzles are exposed;

an exhaust unit including an inlet which is placed in the vicinity of a position between the recording position of the second recording head and the reading position, at least a part of the gas flowed through the space being sucked from the inlet;

an adjustment mechanism configured to change a gap between the ink nozzles and a position where the sheet passes at the recording position, and a control unit configured to perform control such that, prior to recording by the recording head, the supply unit supplies the gas with the gap at a first gap, the adjusting mechanism then changes the gap to a second gap smaller than the first gap, and then recording on the sheet is performed by the recording head being started.

4. The apparatus according to claim 3, wherein the first gap is larger than the diameter of the first roller and the second gap is smaller than the diameter of the first roller.

5. The apparatus according to claim 4, wherein the control unit controls the exhaust unit so that, when the gas is supplied with the second gap, an output of the exhaust unit becomes larger than that when the gas is supplied with the first gap.

6. The apparatus according to claim 5, wherein the control unit controls the supply unit so that, when the gas is supplied with the first gap, an output of the supply unit becomes larger than that when the gas is supplied with the second gap.

7. The apparatus according to claim 3, wherein when the recording is completed, the adjusting mechanism sets the gap at a third gap larger than the second gap, and an output of the exhaust unit becomes temporarily larger than that when the recording is performed.

8. The apparatus according to claim 7, further comprising:

a nozzle cap configured to cap the ink nozzles, wherein, in a standby state in which the recording operation is not performed, the control unit controls so that, in a state in which the gap is set to be the third gap, the nozzle cap is inserted under the recording heads and the ink nozzles are covered with the nozzle cap.

9. The apparatus according to claim 1, further comprising:

a control unit configured to set an output of the exhaust unit during recording in accordance with a sheet to be used.

10. The apparatus according to claim 1, wherein:

the exhaust unit includes a duct having the inlet and a fan causing a gas flow in the duct, and a trap portion for capturing ink mist flying in the gas is provided in the duct between the inlet and the fan.

11. The recording apparatus according to claim 10, wherein:

the trap portion includes a filter for capturing the ink mist or a plurality of ribs formed on an inner wall of the duct.

12. The recording apparatus according to claim 10, wherein:

the exhaust unit exhausts the gas sucked from the inlet to the outside of the apparatus through the duct.

13. The apparatus according to claim 2, further comprising:

a tray configured to cover the bottom of the sheet conveying unit;

wherein the exhaust unit also exhausts the gas from an internal space of the tray.

14. The apparatus according to claim 13, wherein a plurality of stacked layers of the trays having different sizes according to sheet sizes are provided.

15. The apparatus according to claim 1, wherein the reading unit includes an illumination optical system configured to illuminate the sheet in a line shape at the reading position and a reading optical system including an image sensor that reads the illuminated sheet.

16. A method comprising:

recording an image with a first recording head and a second recording head each including ink nozzles on a sheet being conveyed, wherein the sheet is conveyed by a conveying unit including at least a roller pair including a first roller and a second roller which sandwich the sheet at a position between a recording position of the first recording head and a recording position of the second recording head, the first roller is located between the first recording head and the second recording head at least when recording;

reading the image recorded on the sheet with the recording head at a reading position;

supplying a gas to flow through a space where the ink nozzles are exposed, wherein at least a part of the supplied gas flows through a gap between the first recording head and the sheet and a gap between the second recording head and the sheet in the space; and during the recording, sucking a gas from an inlet which is placed in the vicinity of a position between the recording position and the reading position and discharging the gas to a place different from the inlet.

* * * * *